US006901901B2

(12) United States Patent
Nieda et al.

(10) Patent No.: US 6,901,901 B2
(45) Date of Patent: Jun. 7, 2005

(54) RECOIL STARTER

(75) Inventors: Seiichi Nieda, Tokyo (JP); Yuki Kano, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 10/672,541

(22) Filed: Sep. 26, 2003

(65) Prior Publication Data

US 2004/0107935 A1 Jun. 10, 2004

(30) Foreign Application Priority Data

Oct. 2, 2002 (JP) ..... 2002-290398

(51) Int. Cl.[7] ..... F02N 3/02
(52) U.S. Cl. ..... 123/185.3
(58) Field of Search ..... 123/185.2, 185.3

(56) References Cited

U.S. PATENT DOCUMENTS 1,789,423 A * 1/1931 Benson ..... 123/185.3
2,204,750 A * 6/1940 Conover ..... 123/185.1
2,266,865 A * 12/1941 Herrington ..... 74/140
2,597,334 A * 5/1952 Johnson et al. ..... 123/185.4
3,782,355 A * 1/1974 Hamman ..... 123/185.3
4,492,190 A 1/1985 Greenwood et al.
4,970,998 A * 11/1990 Tyler ..... 123/185.3
5,014,657 A * 5/1991 Tsunakawa et al. ..... 123/185.3
5,063,812 A * 11/1991 Mercier ..... 74/575
5,513,607 A * 5/1996 Doragrip et al. ..... 123/185.3
5,676,103 A * 10/1997 Tsunoda et al. ..... 123/185.3
5,715,783 A * 2/1998 Osakabe et al. ..... 123/185.3
6,739,303 B2 * 5/2004 Harada et al. ..... 123/185.14

FOREIGN PATENT DOCUMENTS

DE 3916757 A * 11/1990 ..... F02N/3/02
JP 52027936 A * 3/1977 ..... F02N/3/04
JP 55-48778 11/1980
JP 2-124268 10/1990

* cited by examiner

*Primary Examiner*—Tony M. Argenbright
*Assistant Examiner*—Arnold Castro

(57) ABSTRACT

A recoil starter is disclosed which enables a ratchet member to be manufactured at a reduced cost and which is capable of obtaining a sufficient strength and reducing a size and weight thereof without increasing a thickness of a rope reel and the like. The ratchet members are mounted on the rope reel so as to engage with a control member that is rotatably attached to a reel shaft with a rotational resistance imparted thereto, so that the ratchet members are turned radially outwardly to engage with a drive pulley, to thereby allow the drive pulley to rotate integrally with the rope reel. The ratchet members are each formed of a rod material having a circular section by bending the material and are each pivotally supported on a side surface of the rope reel.

18 Claims, 9 Drawing Sheets

RECOIL STARTER

BACKGROUND OF THE INVENTION

1. Field of the Invention

The present invention relates to a recoil starter, wherein a recoil rope is pulled to rotate a rope reel so that a rotation of the rope reel is transmitted to a rotating member such as a drive pulley or the like coupled to a crankshaft of an engine via a ratchet mechanism, to thereby start the engine.

2. Description of Related Art

A recoil starter is known in which a rope reel is rotated by pulling a recoil rope wound around the rope reel, a rotation of the rope reel is transmitted to a rotating member such as a flywheel magnet or a drive pulley, and a crankshaft of an engine coupled to the rotating member is rotated, to thereby start the engine. Between the rope reel and the rotating member is disposed a ratchet mechanism. When the recoil rope is pulled to rotate the rope reel in an engine starting direction, the ratchet mechanism engages with the rotating member to transmit the rotation to the rotating member, to thereby start the engine. After the engine has been started or when the rope reel is rotated in the direction opposite to the engine starting direction in order to rewind the recoil rope, the ratchet mechanism disengages from the rotating member and acts to ensure that the rotation of the engine side is not transmitted to the rope reel and that the rotation of the rope reel in the opposite direction is not transmitted to the rotating member.

Among ratchet mechanisms in conventional recoil starters, there is a ratchet mechanism which is so constructed that when a ratchet pawl rotatably supported at one end side thereof on the rope reel engages with the drive pulley to transmit rotation to the drive pulley, a distal end of the ratchet pawl abuts against part of the rope reel, whereby the load applied to the ratchet pawl is reduced, as disclosed in Japanese Utility Model Publication No. 55-48778. In this conventional recoil starter, the ratchet pawl is configured by a pawl piece formed of a plate-like material having a cylindrical base portion attached to an end thereof, and the cylindrical base portion is inserted into a hole formed in the rope reel so that the pawl piece is rotated around this hole. Such a ratchet pawl requires to be produced by integrally coupling the plate-like material and the cylindrical material, and thus man-hours to produce these respective parts and man-hours to integrally join both parts are necessary, with a result that there has been the problem that total production costs rise.

Another conventional ratchet mechanism is known in which the ratchet pawl is formed of a steel plate having a relatively small thickness by bending the steel plate into a V shape, a pivot portion is formed at an end of the ratchet pawl by curling an end portion of the ratchet pawl, and the pivot portion is rotatably fitted in a pivot hole formed in a side surface of the rope reel, as disclosed in Japanese Utility Model Application Laid-Open Publication No. 2-124268. This conventional ratchet pawl has the advantage that it can be manufactured at a low cost because it can be manufactured by processing a steel plate into a V shape and curling an end thereof to form the pivot portion. In this instance, the pivot hole of the rope reel that receives the pivot portion of the ratchet pawl is not formed to be completely cylindrical but is open at a side wall portion thereof corresponding to a rotational range of the ratchet pawl that is integrally formed by the steel plate. Therefore, a sufficient strength is not obtained for a portion of the rope reel having the pivot hole formed therein, and thus it is necessary to increase the thickness of the rope reel forming the pivot hole.

SUMMARY OF THE INVENTION

The present invention has been made in view of the foregoing problems.

Accordingly, it is an object of the present invention to provide a recoil starter which enables a ratchet member to be manufactured at a reduced cost.

It is another object of the present invention to provide a recoil starter capable of obtaining a sufficient strength and reducing a size and weight thereof without increasing a thickness of a rope reel and the like.

In accordance with the present invention, there is provided a recoil starter. The recoil starter comprises: a starter casing including a reel shaft disposed coaxially with a crankshaft of an engine, which crankshaft has a drive pulley mounted thereon; a rope reel rotatably supported on the reel shaft and provided at an outer periphery thereof with a drum portion around which a recoil rope is wound; a recoil spring for rotationally urging the rope reel in a direction in which the recoil rope is rewound; a ratchet member disposed on a side surface of the rope reel, the ratchet member being adapted to engage with the drive pulley so that a rotation of the rope reel is transmitted to the drive pulley; and a control member that is rotatably attached to the reel shaft while a rotational resistance is imparted thereto so that the control member disengageably abuts against the ratchet member; wherein when the rope reel is rotated in an engine starting direction by pulling the recoil rope, the ratchet member is pivotally turned so as to engage with the control member and project radially outwardly, whereby the ratchet member engages with the drive pulley to allow the drive pulley to rotate integrally with the rope reel, to thereby start the engine; wherein the ratchet member is formed of a material having a circular shape in section by bending the material; and the ratchet member is pivotally supported on the side surface of the rope reel.

In a preferred embodiment of the present invention, the drive pulley is formed to have a cylindrical shape and has an opening formed in an end portion thereof; the ratchet member includes an arm and a pivot portion formed at one end of the arm in a manner to be bent at a right angle; the rope reel is formed therein with a support hole for rotatably supporting the pivot portion of the ratchet member and is provided with a receiving section for restricting a pivotal movement of the ratchet member by being abutted against a distal end portion of the arm of the ratchet member when the ratchet member is located at a position where the ratchet member radially outwardly projects, so that the ratchet member is pivotally turned about the support hole so as to permit the arm of the ratchet member to be held at the distal end portion thereof on the receiving section of the rope reel while the arm passes through the opening of the drive pulley.

Preferably, the arm of the ratchet member is formed to have a dogleg shape by being bent at a center thereof in a plane perpendicular to the pivot portion of the ratchet member.

It is preferred that the arm of the ratchet member be provided with an end face which is formed to be inclined by cutting so as to prevent the end face from engaging with an edge of the opening of the drive pulley.

It is preferred that the arm of the ratchet member be provided on a side surface thereof with a flat surface which is engageable with the edge of the opening of the drive pulley.

In a preferred embodiment of the present invention, the control member is provided with an engaging edge that is adapted to abut against the ratchet member, the control member being rotatably attached to the reel shaft while the rotational resistance is imparted to the control member by a spring; the ratchet member is urged by an additional spring in a direction in which the arm of the ratchet is pivotally turned so as to move radially inwardly; when the rope reel is rotated in the engine starting direction, the engaging edge abuts against the ratchet member, whereby the arm of the ratchet member is pivotally turned so as to radially outwardly project; and when the rope reel is rotated in the opposite direction by the recoil spring, the engaging edge is disengaged from the ratchet member, whereby the arm of the ratchet member is pivotally turned so as to move radially inwardly.

In a preferred embodiment of the present invention, the starter casing is provided on a side surface thereof with an air inlet for introducing air for cooling the engine; and the rope reel includes a boss portion formed at a center thereof, the rope reel having an air passage which is formed between the drum portion and the boss portion thereof in such a manner to face the air inlet of the starter casing.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Figure 1:
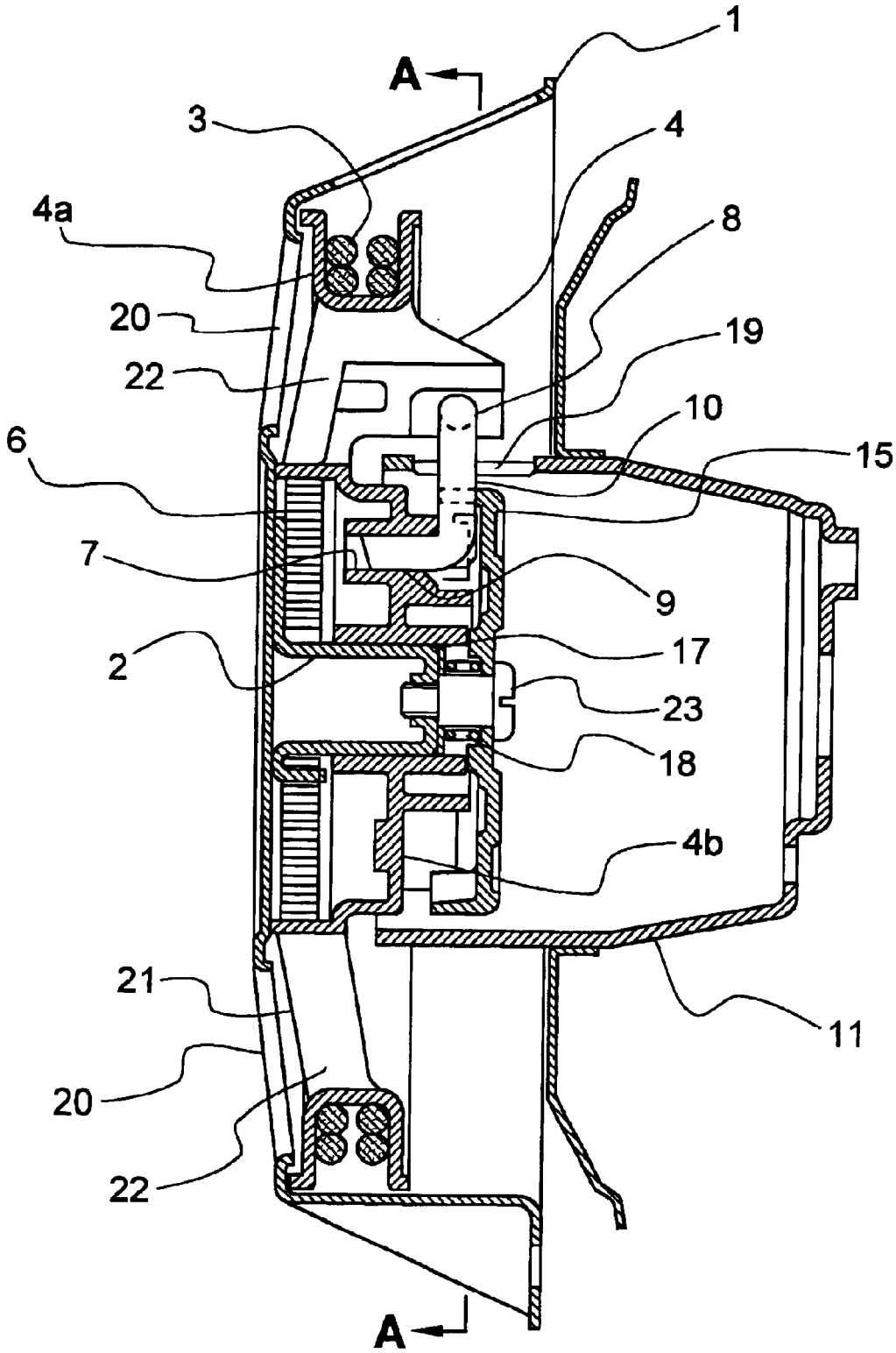
FIG. 1 is a sectional side elevation view showing a recoil starter according to an embodiment of the invention.
Figure 2:
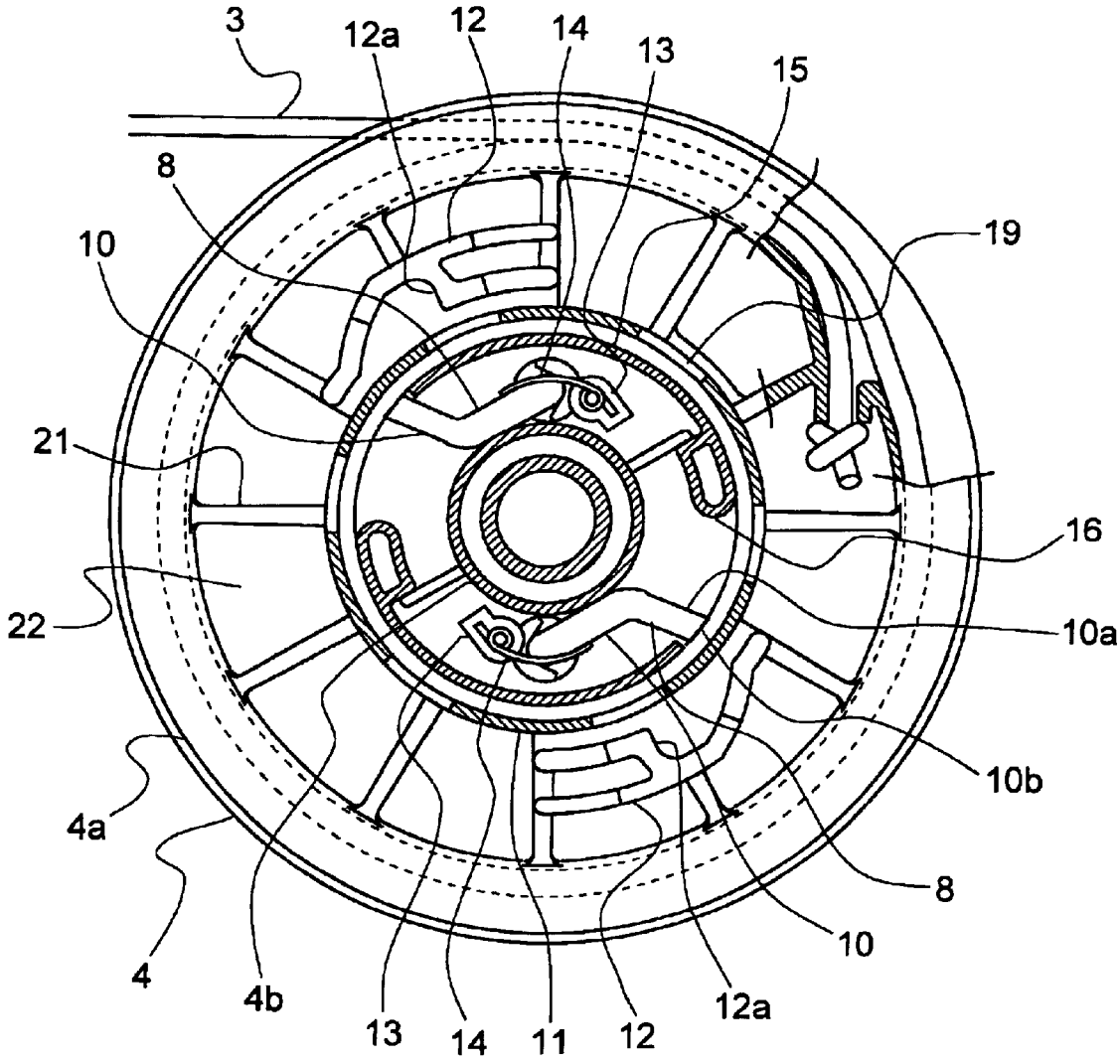
FIG. 2 is a cross-sectional view taken along line A—A of FIG. 1.
Figure 3:
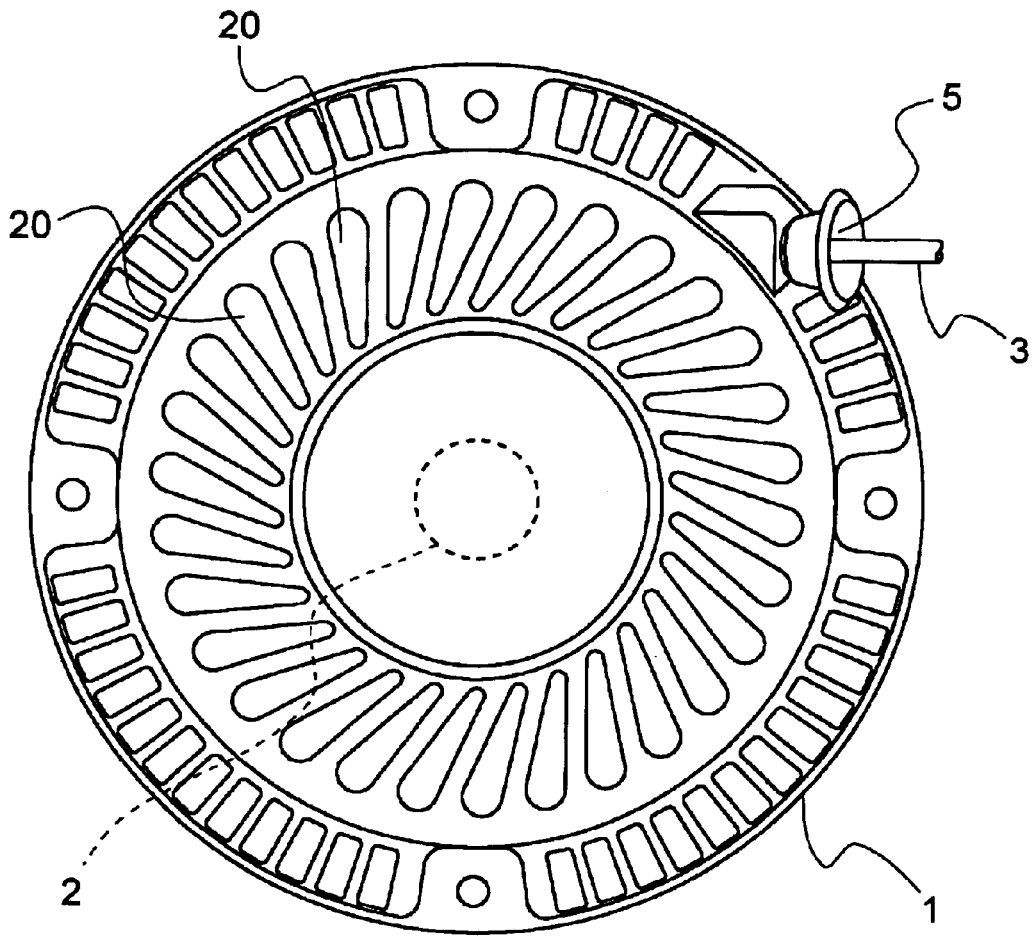
FIG. 3 is a front view of the recoil starter of FIG. 1.

An embodiment of the invention will be described below by way of example with reference to the drawings. As shown in FIG. 1, a recoil starter of the illustrated embodiment includes a starter casing 1 which is formed so as to receive therein main components of the recoil starter and cover a side surface portion of an engine. The starter casing 1 is provided at an inner side surface thereof with a reel shaft 2 which is formed coaxially with a crankshaft (not shown) of the engine so as to face the crankshaft. A rope reel 4, which has a recoil rope 3 wound around an outer periphery thereof, is rotatably mounted to the reel shaft 2. As shown in FIG. 2, the recoil rope 3 is wound around a drum portion 4*a* formed at the outer periphery of the rope reel 4. One end of the recoil rope 3 is fixed to the rope reel 4, and the other end of the recoil rope 3 is pulled out to the outside of the starter casing 1, as shown in FIG. 3, through an opening 5 formed in the starter casing 1. By pulling the other end of the recoil rope 3, the rope reel 4 is rotationally driven around the reel shaft 2.

A recoil spring 6 is disposed between a side surface of the rope reel 4 and an outer peripheral surface of the reel shaft 2 provided at the inner side surface of the starter casing 1. The recoil spring 6 is adapted to rotate, in the opposite direction, the rope reel 4 which has been rotated by pulling the recoil rope 3 to rewind the pulled out recoil rope 3 around the rope reel 4. The recoil spring 6 has an inner-peripheral end thereof fixed to the reel shaft 2 and an outer-peripheral end thereof fixed to the rope reel 4. When the recoil rope 3 is pulled to rotate the rope reel 4, a rotational force is accumulated in the recoil spring 6. By releasing the recoil rope 3, the rope reel 4 is rotated in the opposite direction by the rotational force accumulated in the recoil spring 6, and the recoil rope 3 pulled out to the outside of the starter casing 1 is rewound around the rope reel 4.

Figure 4:
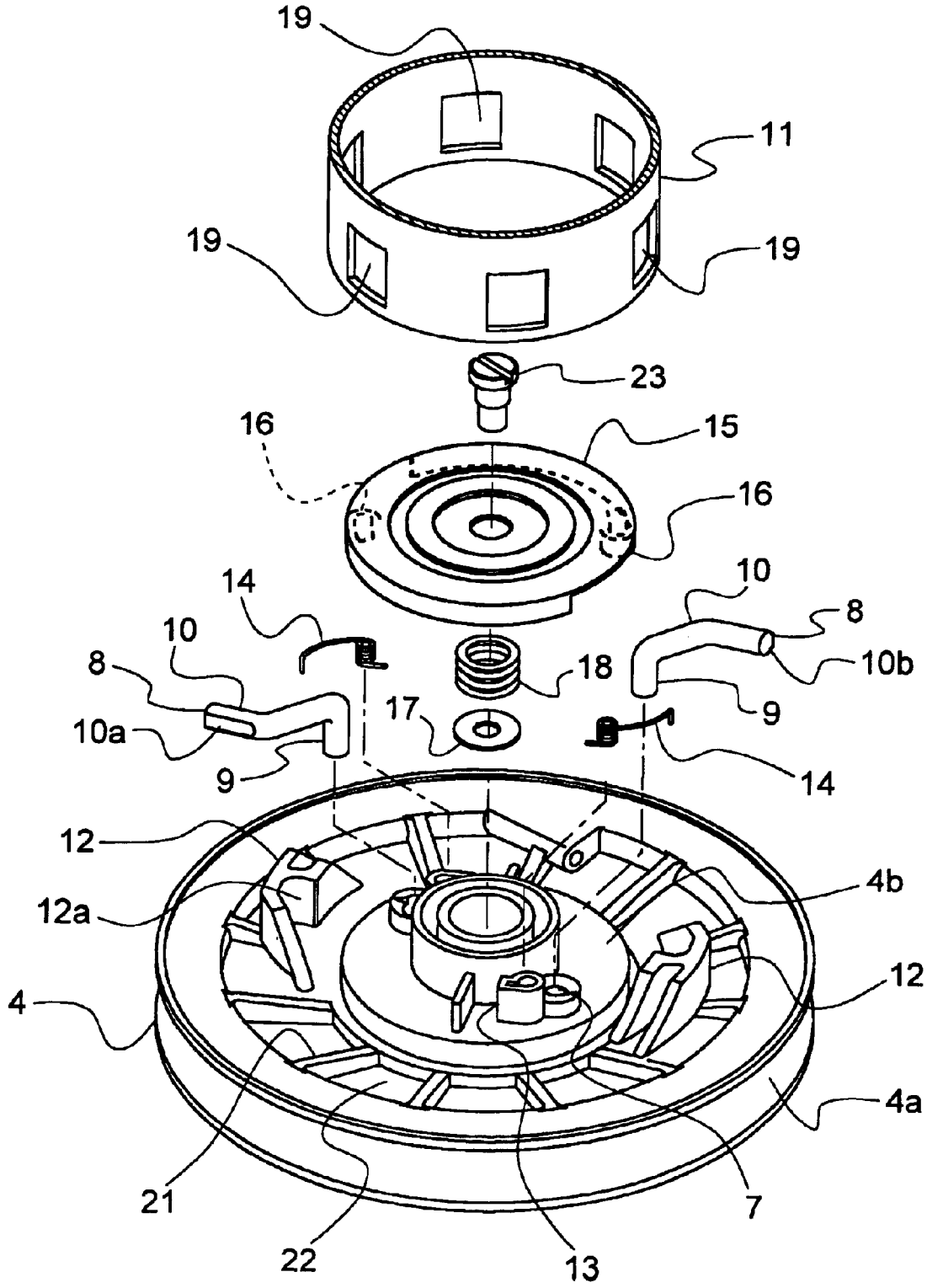
FIG. 4 is an exploded perspective view showing the configuration of main components of the recoil starter of FIG. 1.

As shown in FIG. 4, the rope reel 4 has support holes 7, each of which has an axis parallel to an axis of the reel shaft 2, formed in the other side surface thereof. Ratchet members 8 are pivotally supported in the respective support holes 7. The ratchet members 8 are each adapted to engage with a drive pulley 11 attached to the crankshaft of the engine, whereby a rotation of the rope reel 4 in an engine starting direction is transmitted to the drive pulley 11.

Figure 5:
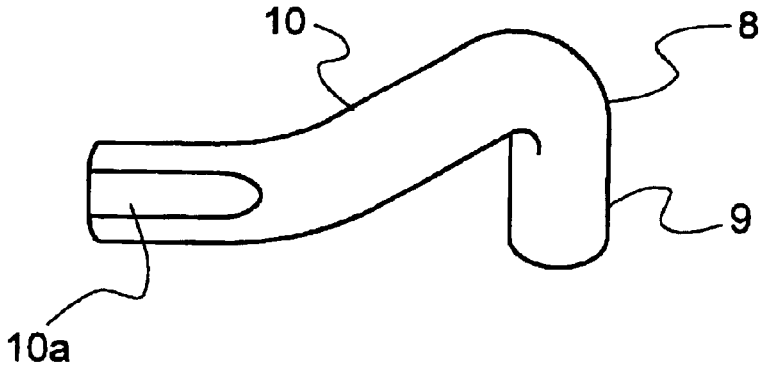
FIG. 5 is a perspective view showing a ratchet member used in the embodiment of FIG. 1.
Figure 6:
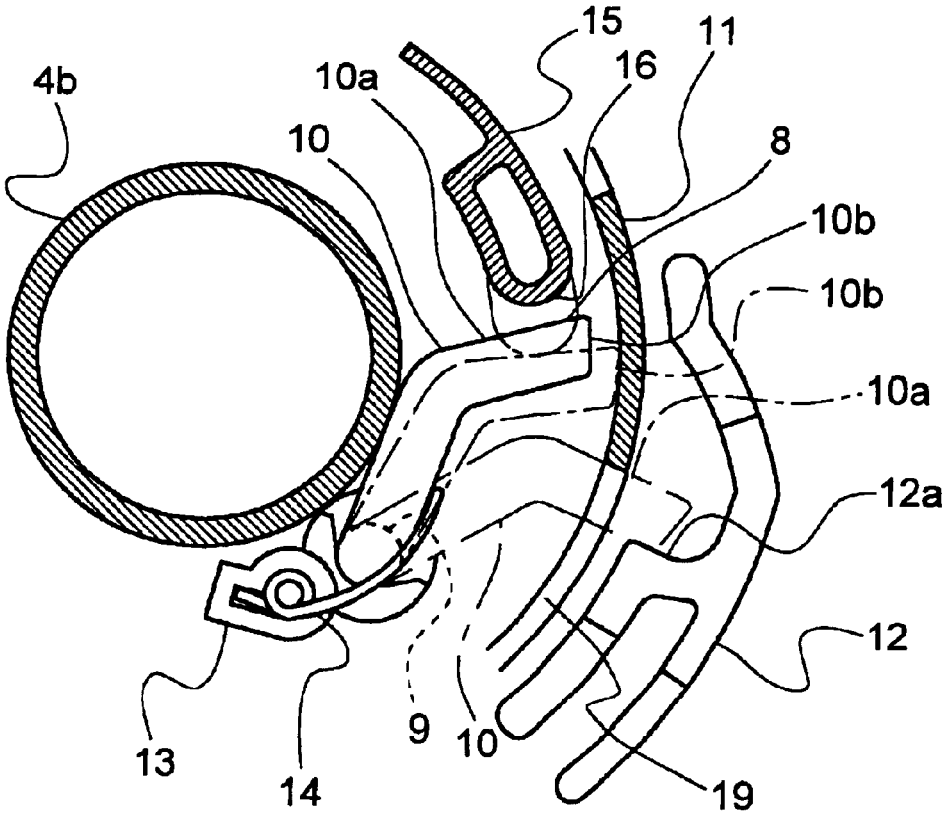
FIG. 6 is an enlarged partial cross-sectional view similar to FIG. 2, showing an operating state of the ratchet member.

As shown in FIG. 5, each ratchet member 8 is formed by cutting, to a predetermined length, a rod material having a circular shape in section, such as steel material or the like, wherein one end portion thereof is bent at substantially a right angle to form a pivot portion 9 that is to be inserted into the support hole 7, and the remaining portion thereof, which extends perpendicularly from the pivot portion 9, is then bent at a substantially central position thereof in a horizontal direction or in a plane perpendicular to the pivot portion 9 so as to form an arm 10 having a dogleg shape or a V shape. As shown in FIG. 6, each ratchet member 8 is rotatably supported at the pivot portion 9 thereof inserted in the support hole 7 of the rope reel 4, so as to pivotally move between a position at which a proximal portion of the arm 10 abuts against an outer peripheral surface of a boss portion 4*b* of the rope reel 4 and a position at which a distal end portion of the arm 10 abuts against a receiving surface 12*a* of a receiving section 12 formed on the rope reel 4 radially outwardly of the boss portion 4*b* thereof. Moreover, a spring mount 13 is formed near each support hole 7. A torsion coil spring 14 is mounted in each of the spring mounts 13 so as to act on a corresponding one of the ratchet members 8, so that each ratchet member 8 is urged toward the position at which the proximal portion of the arm 10 abuts against the outer peripheral surface of the boss portion 4*b* of the rope reel 4. The ratchet members 8 are rotated integrally with the rope reel 4.

As shown in FIG. 1, a control member 15 is attached to an end face of the reel shaft 2 by a screw 23 via a washer 17 and a spring 18. The control member 15 functions as a mechanism for preventing the rope reel 4 from slipping off the reel shaft 2. The control member 15 is rotatably supported in a state where a predetermined rotational resistance or frictional resistance is imparted to the reel shaft 2 by the washer 17 and the spring 18. A peripheral wall of the control member 15 is partly cut out so that engaging edges 16 are formed so as to abut against the respective arms 10 of the ratchet members 8. When the ratchet members 8 are rotated together with the rope reel 4, the engaging edges 16 engage with the respective arms 10 of the ratchet members 8, so that the ratchet members 8 are each pivotally turned about the pivot portion 9 thereof toward the position where the distal end portion of the arm 10 abuts against the respective receiving surface 12*a* of the receiving section 12 formed on the rope reel 4 radially outwardly of the boss portion 4*b*. After the distal end portions of the arms 10 of the ratchet members 8 abut against the respective receiving surfaces 12*a* of the receiving sections 12, the control member 15 is rotated integrally with the rope reel 4 counter to the rotational resistance.

An end portion of the drive pulley 11 integrally coupled with the crankshaft of the engine is formed to have a cylindrical shape. A plurality of openings 19 are formed in a peripheral wall thereof near the edge of the drive pulley 11 at equal intervals in a circumferential direction by removing parts of the peripheral wall. When the starter casing 1 of the recoil starter is attached to the engine in a state where the drive pulley 11 is attached to the crankshaft of the engine, the cylindrical end portion of the drive pulley 11 is disposed between the outer periphery of the control member 15 and the receiving sections 12 formed at the rope reel 4 of the recoil starter. When the distal end portions of the arms 10 of the ratchet members 8 are pivotally turned radially outwardly, the arms 10 pass through the respective openings 19 and outwardly project from the peripheral wall of the drive pulley 11 so that the arms 10 engage with respective edges of the openings 19, whereby the rotation of the rope reel 4 is transmitted to the drive pulley 11 via the ratchet members 8.

As shown in FIG. 5, each of the ratchet members 8 has a flat surface 10*a* formed at a rear side of the distal end portion thereof by flatly pressing the outer side surface of the round rod material. The flat surfaces 10*a* abut against the respective edges of the openings 19 formed in the drive pulley 11 to thereby transmit a rotational force to the drive pulley 11. Also, each of the ratchet members 8 has an inclined surface 10*b* formed at the end of the arm 10 thereof to prevent the end face of the arm 10 from engaging with any edge of the openings 19 of the drive pulley 11 and clutching when the arm 10 of the ratchet member 8 is pivotally turned radially outwardly. As indicated by alternate long and short dashed lines in FIG. 6, the inclined surface 10*b* ensures that the end face of the arm 10 does not engage with any edge of the openings 19 of the drive pulley 11.

Air inlets 20 for introducing air for cooling the engine to the inside of the engine are formed in the side surface of the starter casing 1. A plurality of ribs 21 that extend in a radial direction are formed between the drum portion 4*a* formed at the outer periphery of the rope reel 4 and the boss portion 4*b* of the center of the rope reel 4 such that air passages 22 that extend through the rope reel 4 from one side thereof to the other side thereof are formed between the adjacent ribs 21. The air passages 22 are formed to face the air inlets 20 formed in the side surface of the starter casing 1. Cooling air that cools the engine passes through the air inlets 20 of the starter casing 1 and the air passages 22 of the rope reel 4 and flows into the engine. The air passages 22 thus formed in the rope reel 4 permit cooling air to pass therethrough, so that flowing of cooling air into the engine can be positively performed even when the rope reel 4 is formed to have a large outer diameter, with a result that cooling of the engine can be efficiently conducted.

Figure 7:
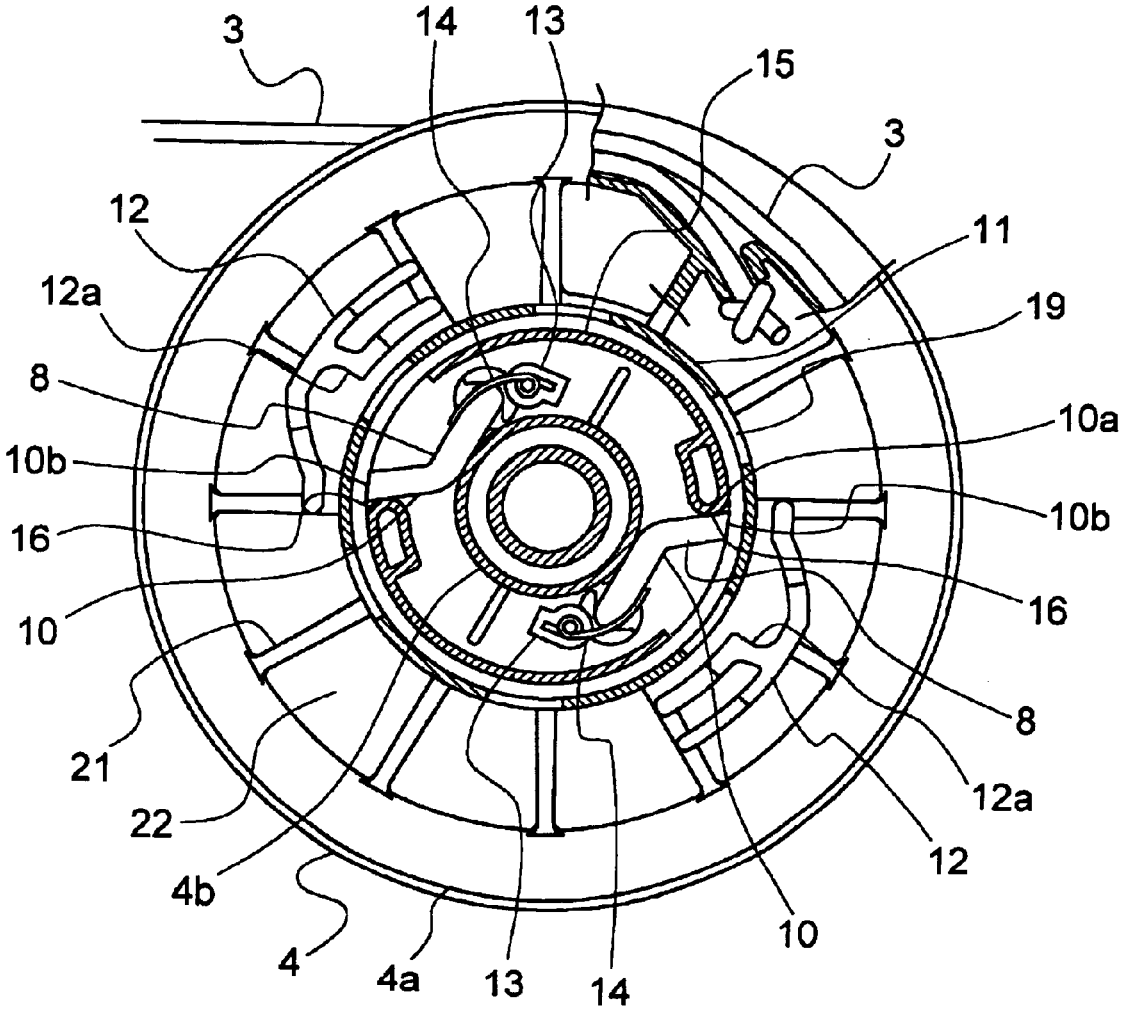
FIG. 7 is a cross-sectional view similar to FIG. 2, showing a state where the ratchet members abut against a control member.

Now, the operation of the recoil starter of the illustrated embodiment will be described. Prior to the starting operation of the engine, as shown in FIG. 2, the ratchet members 8 are kept in a state where the ratchet members 8 are turned to the inner side position where the rear surfaces of the arms 10 abut against the boss portion 4*b* of the rope reel 4 by the action of the respective torsion coil springs 14, so that the distal end portions of the ratchet members 8 are disposed in a state where they are separated from the drive pulley 11. When the rope reel 4 is rotated by pulling the recoil rope 3, the ratchet members 8 are rotated integrally with the rope reel 4. The control member 15 does not rotate since the control member 15 is attached to the reel shaft 2 with the predetermined rotational resistance. Therefore, as shown in FIG. 7, the flat surfaces 10*a* of the arms 10 of the ratchet members 8 abut against the respective engaging edges 16 of the control member 15.

Figure 8:
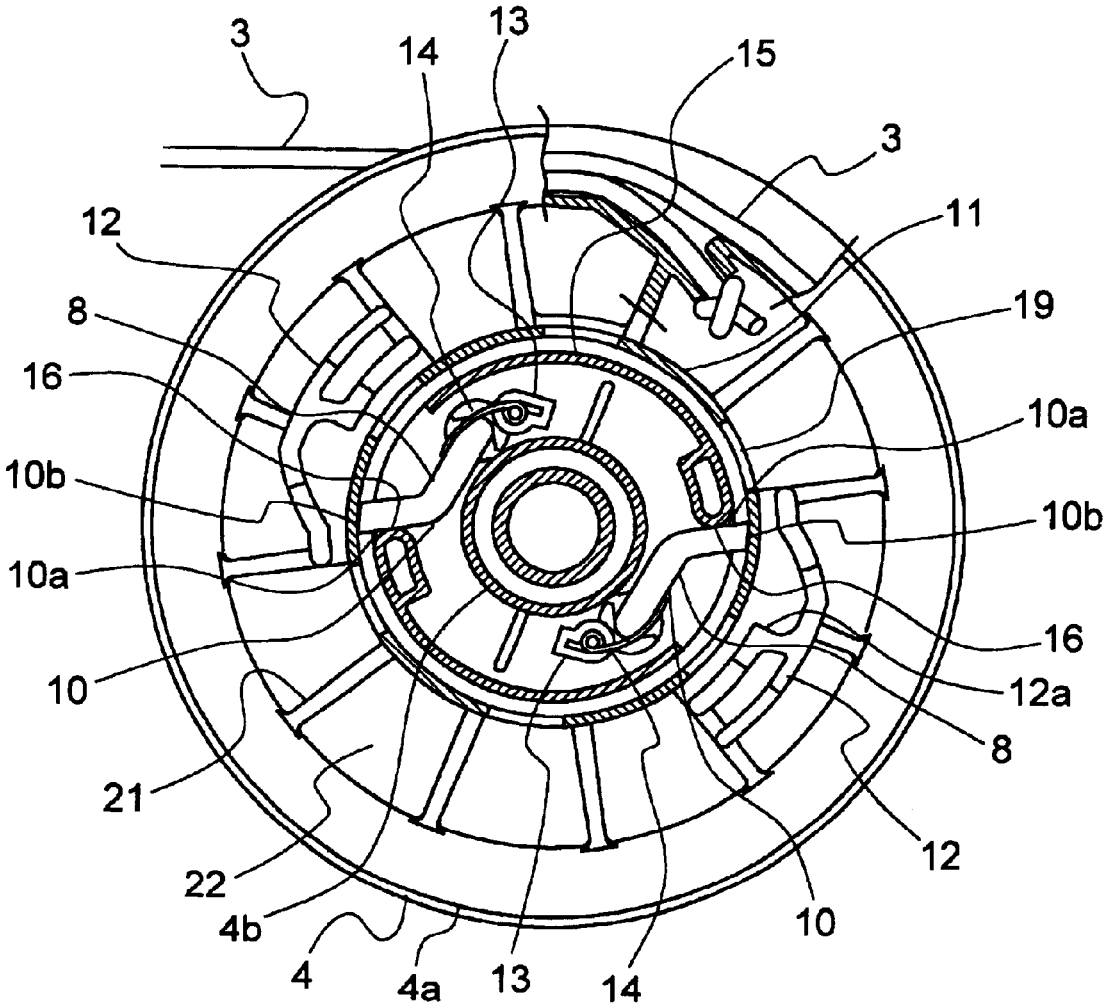
FIG. 8 is a cross-sectional view similar to FIG. 2, showing a state where the ratchet members have been pivotally turned to respective positions at which distal ends thereof abut against a drive pulley.

When the rope reel 4 is further rotated, the ratchet members 8 also rotate around the reel shaft 2, whereas the distal end portions of the arms 10 of the ratchet members 8 abut against the respective engaging edges 16 of the control member 15, so that further rotation of the distal end portions of the arms 10 around the reel shaft 2 is precluded. Thus, the ratchet members 8 are pivotally turned around the respective pivot portions 9 so that the distal end portions of the arms 10 project radially outwardly. As shown in FIG. 8, when surface portions of the peripheral wall formed between the openings 19 of the drive pulley 11 are positioned immediately at the outer sides of the ratchet members 8, the distal ends of the ratchet members 8 abut against the surface portions of the peripheral wall of the drive pulley 11, whereby the ratchet members 8 are precluded from being pivotally turned around the respective pivot portions 9. However, as the control member 15 is integrally rotated with the rope reel 4, the distal ends of the ratchet members 8 slide along the inner surface portions of the peripheral wall of the drive pulley 11, so that the ratchet members 8 are rotated about the reel shaft 2 until the distal ends of the ratchet members 8 reach the respective openings 19 of the drive pulley 11.

Figure 9:
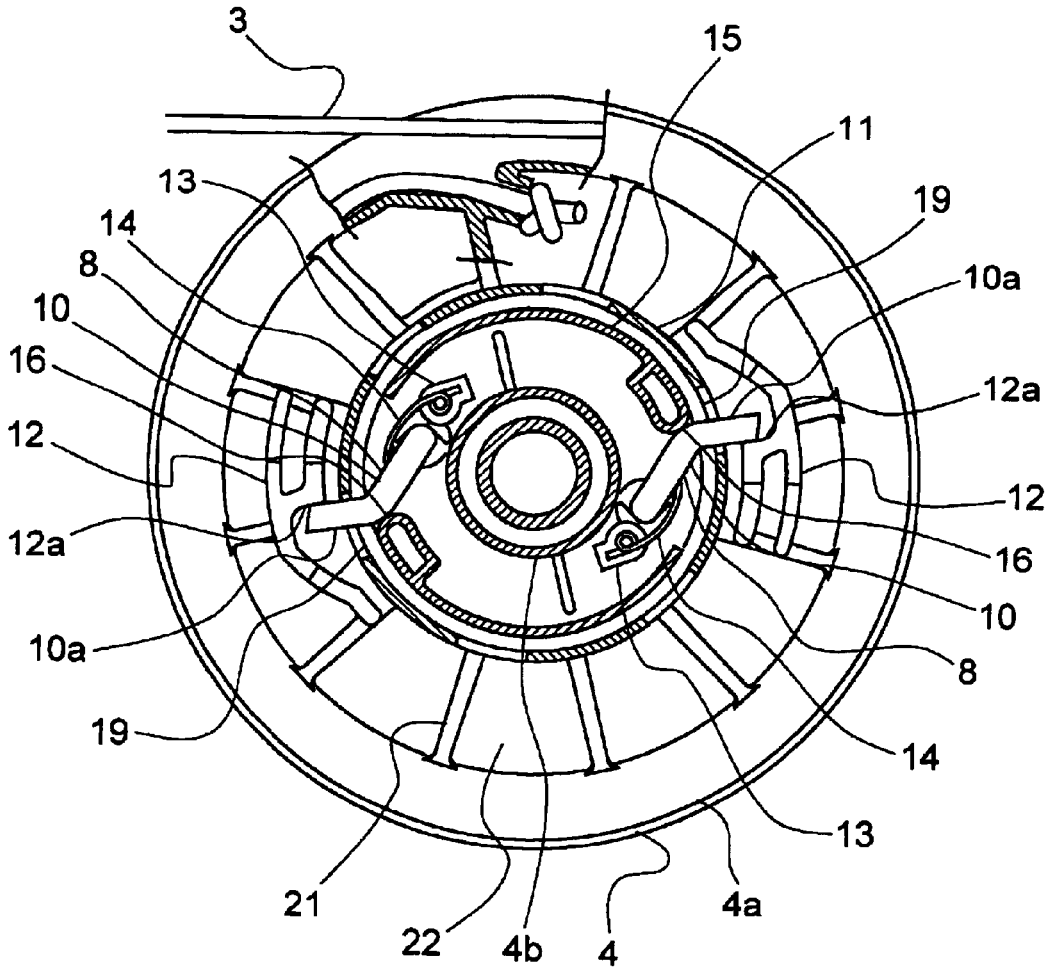
FIG. 9 is a cross-sectional view similar to FIG. 2, showing a state where the ratchet members have been pivotally turned until they abut against respective receiving sections of a rope reel.
Figure 10:
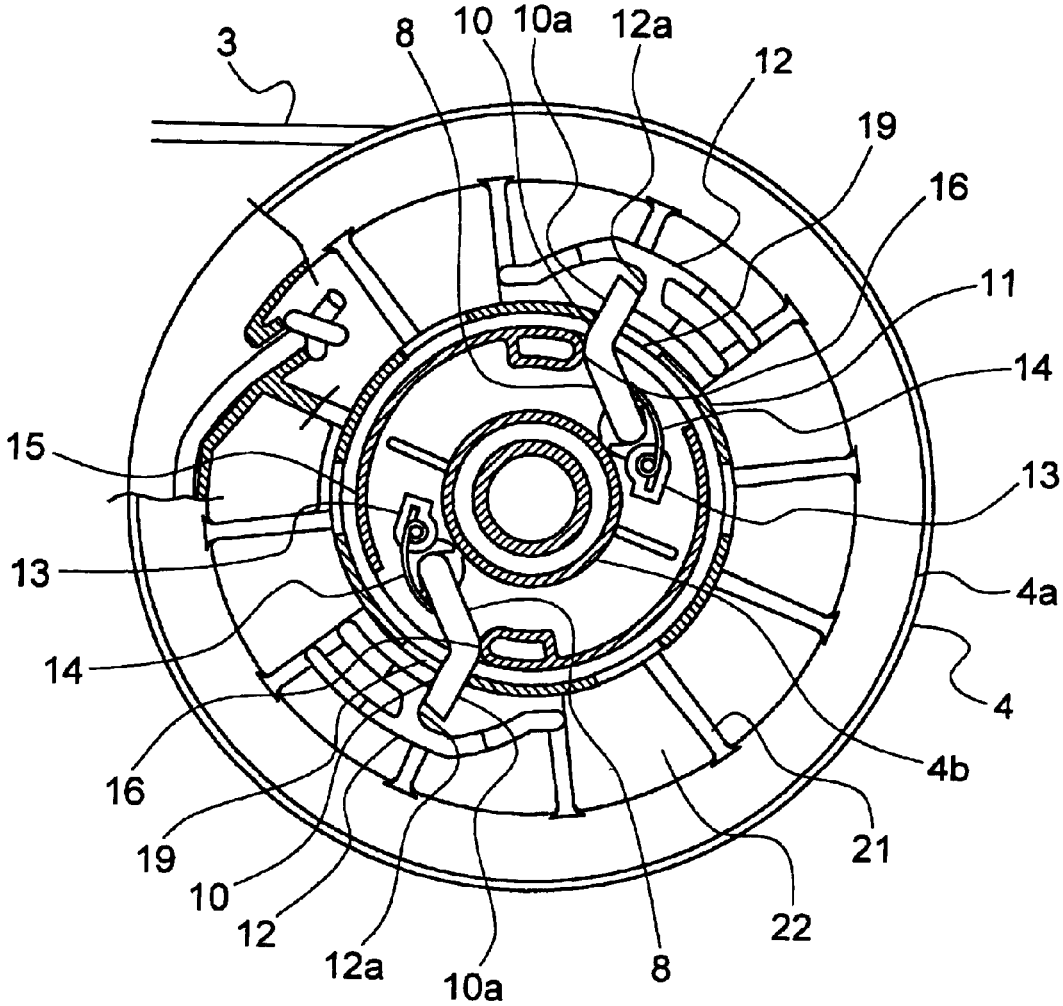
FIG. 10 is cross-sectional view similar to FIG. 2, showing a state where the drive pulley is rotated by the rope reel while the ratchet members are engaged with the drive pulley.

When the distal ends of the arms 10 of the ratchet members 8 reach the respective openings 19 of the drive pulley 11, the ratchet members 8 are further turned about the respective pivot portions 9 by the engaging edges 16 of the control member 15 while the distal end portions of the arms 8 pass through the respective openings 19, so that the distal end portions of the arms 10 abut against the respective receiving surfaces 12*a* of the receiving sections 12 formed at the outer peripheral side of the rope reel 4 as shown in FIG. 9, whereby the ratchet members 8 are prevented from being turned further around the respective pivot portions 9. Thereafter, the control member 15 is rotated in the engine starting direction integrally with the rope reel 4 counter to the rotational resistance resulting from the spring 18. As a result, as shown in FIG. 10, the flat surfaces 10*a* formed on the arms 10 of the ratchet members 8 engage with the respective engaging edges of the openings 19 of the drive pulley 11, so that the drive pulley 11 is integrally rotated with the rope reel 4, to thereby start the engine.

After the engine has started, the crankshaft rotates in the engine starting direction, whereby the drive pulley 11 is rotated, and the opposite edges of the openings 19 of the drive pulley 11 respectively engage with the ratchet members 8, with a result that the ratchet members 8 are pivotally turned around the respective pivot portions 9 so that the arms 10 move radially inwardly. Thus, the ratchet members 8 separate from the drive pulley 11, so that the rotation of the engine is not transmitted to the rope reel 4. While the arms 10 of the ratchet members 8 are being pivotally turned radially inwardly, the control member 15 is rotated counter to the rotational resistance. When the engine has not started, the recoil rope 3 is slackened, whereby the rope reel 4 is rotated in the opposite direction by the rotational force accumulated in the recoil spring 6, resulting in the recoil rope 3 being rewound around the rope reel 4. At this time, the ratchet members 8 also rotate in the opposite direction integrally with the rope reel 4 so that the rear surfaces of the arms 10 of the ratchet members 8 separate from the respective engaging edges 16 of the control member 15, whereby the arms 10 are turned radially inwardly around the respective pivot portions 9 due to the action of the respective torsion coil springs 14, with a result that the ratchet members 8 separate from the drive pulley 11.

As described above, according to the invention, the ratchet member is formed of a material having a circular shape in section by bending the material, and the ratchet member is pivotally supported on the side surface of the rope reel. Thus, it is possible to manufacture the ratchet member simply by pressing, for example, a round bar made of a metal material, so that the number of man-hours needed to manufacture the ratchet members can be decreased, resulting in manufacturing costs being reduced.

In one embodiment of the invention, the ratchet member includes the pivot portion formed at one end thereof in a manner to be bent at a right angle, and the pivot portion is inserted and supported in the support hole formed in the rope reel. Such construction permits the support hole to be formed as a completely round hole, so that the strength of the vicinity of the support hole can be sufficiently secured. In addition, the distal end portion of the arm of the ratchet member is held by the receiving section formed in the rope reel. Therefore, a sufficient strength can be obtained without increasing the thickness of the rope reel, resulting in a size and weight of the recoil starter being reduced.

In one embodiment of the invention, the arm of the ratchet member is formed to have a dogleg shape in a manner to be bent at the center thereof. Such construction permits the ratchet member to project at a small operating angle to the position at which the arm of the ratchet member abuts against the drive pulley, so that a play in the rotation angle can be made small, with a result that the rotation of the rope reel can be efficiently transmitted to the drive pulley.

In one embodiment of the invention, the end face of the ratchet member is inclined by cutting. Such construction can prevent the end face of the ratchet member from engaging with the edge of the opening of the drive pulley and locking.

In one embodiment of the invention, the flat surface is formed on the side surface of the arm of the ratchet member that engages with the drive pulley. Such construction ensures the ratchet member a large surface area which comes into contact with the drive pulley to prevent wear of the ratchet member, so that the durability of the recoil starter can be improved.

In one embodiment of the invention, when the rope reel is rotated in the engine starting direction, the ratchet member is abutted against the control member to which a rotational resistance is imparted by the spring, whereby the arm of the ratchet member is pivotally turned so as to radially outwardly project. Such construction permits a structure for pivotally turning the ratchet member to be simplified, resulting in a size and weight of the recoil starter being reduced.

In one embodiment of the invention, the air inlet for introducing air for cooling the engine is formed in the side surface of the starter casing, and the air passage is formed between the drum portion formed at the outer periphery of the rope reel and the boss portion formed at the center thereof in such a manner to face the air inlet. Therefore, even in a case where the rope reel is formed to have an increased outer diameter in order to reduce the pulling load of the recoil rope, the flow of air for cooling the engine is not blocked by the rope reel, resulting cooling of the engine being efficiently conducted.

While an illustrative and presently preferred embodiment of the present invention have been described in detail herein, it is to be understood that the inventive concepts may be otherwise variously embodied and employed and that the appended claims are intended to be construed to include such variations except insofar as limited by the prior art.

What is claimed is:

1. A recoil starter comprising:

a starter casing including a reel shaft disposed coaxially with a crankshaft of an engine, which crankshaft has a drive pulley mounted thereon;

a rope reel rotatably supported on said reel shaft and provided at an outer periphery thereof with a drum portion around which a recoil rope is wound;

a recoil spring for rotationally urging said rope reel in a direction in which said recoil rope is rewound;

a ratchet member disposed on a side surface of said rope reel, said ratchet member being adapted to engage with said drive pulley so that a rotation of said rope reel is transmitted to said drive pulley; and a control member that is rotatably attached to said reel shaft while a rotational resistance is imparted thereto so that said control member disengageably abuts against said ratchet member;

wherein when said rope reel is rotated in an engine starting direction by pulling said recoil rope, said ratchet member is pivotally turned so as to engage with said control member and project radially outwardly, whereby said ratchet member engages with said drive pulley to allow said drive pulley to rotate integrally with said rope reel, to thereby start the engine;

wherein said ratchet member is formed of a material having a circular shape in section by bending said material; and said ratchet member is pivotally supported on said side surface of said rope reel.

2. The recoil starter according to claim 1, wherein said drive pulley is formed to have a cylindrical shape and has an opening formed in an end portion thereof;

said ratchet member includes an arm and a pivot portion formed at one end of said arm in a manner to be bent at a right angle;

said rope reel is formed therein with a support hole for rotatably supporting said pivot portion of said ratchet member and is provided with a receiving section for restricting a pivotal movement of said ratchet member by being abutted against a distal end portion of said arm of said ratchet member when said ratchet member is located at a position where said ratchet member radially outwardly projects, so that said ratchet member is pivotally turned about said support hole so as to permit said arm of said ratchet member to be held at said distal end portion thereof on said receiving section of said rope reel while said arm passes through said opening of said drive pulley.

3. The recoil starter according to claim 2, wherein said arm of said ratchet member is formed to have a dogleg shape by being bent at a center thereof in a plane perpendicular to said pivot portion of said ratchet member.

4. The recoil starter according to claim 2, wherein said arm of said ratchet member is provided with an end face which is formed to be inclined by cutting so as to prevent said end face from engaging with an edge of said opening of said drive pulley.

5. The recoil starter according to claim 3, wherein said arm of said ratchet member is provided with an end face which is formed to be inclined by cutting so as to prevent said end face from engaging with an edge of said opening of said drive pulley.

6. The recoil starter according to claim 2, wherein said arm of said ratchet member is provided on a side surface thereof with a flat surface which is engageable with the edge of said opening of said drive pulley.

7. The recoil starter according to claim 3, wherein said arm of said ratchet member is provided on a side surface thereof with a flat surface which is engageable with the edge of said opening of said drive pulley.

8. The recoil starter according to claim 4, wherein said arm of said ratchet member is provided on a side surface thereof with a flat surface which is engageable with the edge of said opening of said drive pulley.

9. The recoil starter according to claim 2, wherein said control member is provided with an engaging edge that is adapted to abut against said ratchet member, said control member being rotatably attached to said reel shaft while the rotational resistance is imparted to said control member by a spring;

said ratchet member is urged by an additional spring in a direction in which said arm of said ratchet is pivotally turned so as to move radially inwardly;

when said rope reel is rotated in the engine starting direction, said engaging edge abuts against said ratchet member, whereby said arm of said ratchet member is pivotally turned so as to radially outwardly project; and when said rope reel is rotated in the opposite direction by said recoil spring, said engaging edge is disengaged from said ratchet member, whereby said arm of said ratchet member is pivotally turned so as to move radially inwardly.

10. The recoil starter according to claim 3, wherein said control member is provided with an engaging edge that is adapted to abut against said ratchet member, said control member being rotatably attached to said reel shaft while the rotational resistance is imparted to said control member by a spring;

said ratchet member is urged by an additional spring in a direction in which said arm of said ratchet is pivotally turned so as to move radially inwardly;

when said rope reel is rotated in the engine starting direction, said engaging edge abuts against said ratchet member, whereby said arm of said ratchet member is pivotally turned so as to radially outwardly project; and when said rope reel is rotated in the opposite direction by said recoil spring, said engaging edge is disengaged from said ratchet member, whereby said arm of said ratchet member is pivotally turned so as to move radially inwardly.

11. The recoil starter according to claim 4, wherein said control member is provided with an engaging edge that is adapted to abut against said ratchet member, said control member being rotatably attached to said reel shaft while the rotational resistance is imparted to said control member by a spring;

said ratchet member is urged by an additional spring in a direction in which said arm of said ratchet is pivotally turned so as to move radially inwardly;

when said rope reel is rotated in the engine starting direction, said engaging edge abuts against said ratchet member, whereby said arm of said ratchet member is pivotally turned so as to radially outwardly project; and when said rope reel is rotated in the opposite direction by said recoil spring, said engaging edge is disengaged from said ratchet member, whereby said arm of said ratchet member is pivotally turned so as to move radially inwardly.

12. The recoil starter according to claim 6, wherein said control member is provided with an engaging edge that is adapted to abut against said ratchet member, said control member being rotatably attached to said reel shaft while the rotational resistance is imparted to said control member by a spring;

said ratchet member is urged by an additional spring in a direction in which said arm of said ratchet is pivotally turned so as to move radially inwardly;

when said rope reel is rotated in the engine starting direction, said engaging edge abuts against said ratchet member, whereby said arm of said ratchet member is pivotally turned so as to radially outwardly project; and when said rope reel is rotated in the opposite direction by said recoil spring, said engaging edge is disengaged from said ratchet member, whereby said arm of said ratchet member is pivotally turned so as to move radially inwardly.

13. The recoil starter according to claim 1, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

14. The recoil starter according to claim 2, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

15. The recoil starter according to claim 3, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

16. The recoil starter according to claim 4, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

17. The recoil starter according to claim 6, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

18. The recoil starter according to claim 9, wherein said starter casing is provided on a side surface thereof with an air inlet for introducing air for cooling the engine; and said rope reel includes a boss portion formed at a center thereof, said rope reel having an air passage which is formed between said drum portion and said boss portion thereof in such a manner to face said air inlet of said starter casing.

* * * * *